United States Patent [19]

Bajohr

[11] Patent Number: 4,733,594

[45] Date of Patent: Mar. 29, 1988

[54] FILLING ARRANGEMENT

[75] Inventor: Walter Bajohr, Troisdorf, Fed. Rep. of Germany

[73] Assignee: Dynamit Nobel Aktiengesellschaft, Fed. Rep. of Germany

[21] Appl. No.: 890,327

[22] Filed: Jul. 29, 1986

[30] Foreign Application Priority Data

Jul. 30, 1985 [DE] Fed. Rep. of Germany ..... 3527169

[51] Int. Cl.[4] ..... F42B 33/02; B67C 3/26; G01F 11/10

[52] U.S. Cl. ..... 86/31; 86/29; 86/33; 141/250; 141/284; 222/55; 222/344; 222/345; 222/359; 222/360; 222/361

[58] Field of Search ..... 86/31, 25, 26, 27, 29, 86/33; 222/252, 344–345, 289, 282, 360, 359, 346, 309, 55, 361; 141/108, 109, 129, 250, 286; 414/421

[56] References Cited

U.S. PATENT DOCUMENTS

| | | | |
|---|---|---|---|
| 2,856,807 | 10/1958 | Stutzman | 86/31 |
| 3,570,558 | 3/1971 | Lachaussee | 141/140 |
| 3,580,128 | 5/1971 | Leich | 86/29 |
| 3,752,033 | 8/1973 | Ross | 86/33 |
| 3,796,127 | 3/1974 | Deitemeyer | 86/31 |
| 4,186,646 | 2/1980 | Martin | 86/29 |
| 4,295,409 | 10/1981 | Simpson | 86/31 |
| 4,629,093 | 12/1986 | Le Molaire | 86/31 |

FOREIGN PATENT DOCUMENTS 921018 12/1954 Fed. Rep. of Germany .

*Primary Examiner*—Stephen J. Lechert, Jr.
*Assistant Examiner*—Howard J. Locker
*Attorney, Agent, or Firm*—Antonelli, Terry & Wands

[57] ABSTRACT

A filling arrangement is equipped with a loading arrangement containing a measuring slider plate and a displacement arrangement guided through a protective wall. The displacement arrangement moves the measuring slider plate backwards and forwards between two end positions; the displacement arrangement has a force transfer arrangement with a push rod guided through the protective wall and connected with the measuring slide place. The force transfer arrangement is driveable in both directions by means of at least one weight. A distribution arrangement for the supply of explosive from explosive containers to the loading arrangement comprises at least one container holder which is tippable by a shaft guided through the protective wall. A horizontally and parallel guided loading plate is pivotable over a delivery arrangement from an entry position at an entry opening in the protective wall into a first end position below the loading arrangement.

22 Claims, 5 Drawing Figures

FIG. 3
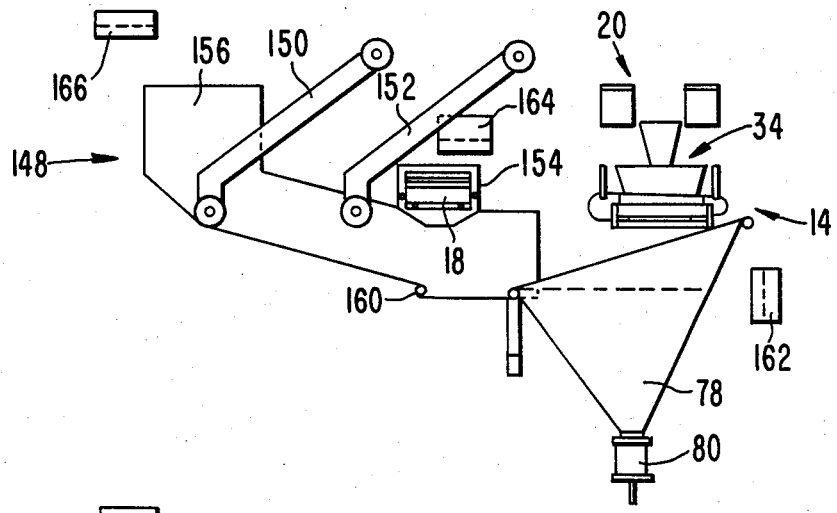
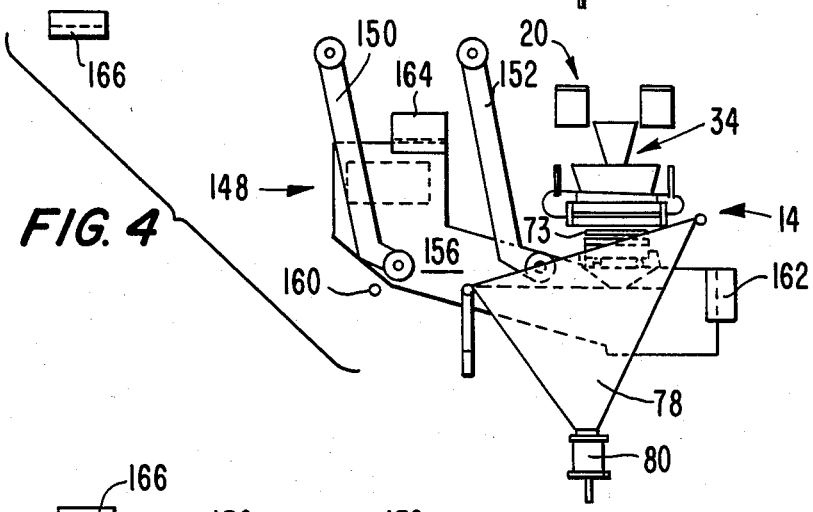
FIG. 4
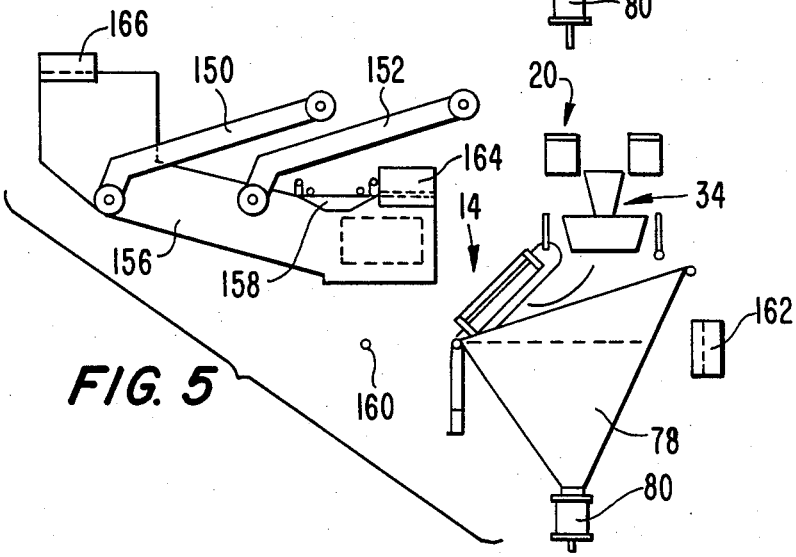
FIG. 5

FILLING ARRANGEMENT

This invention relates to a filling arrangement for dangerous substances, especially explosives.

A known hand-operated explosive filling arrangement consists of a loading arrangement with a filling plate which comprises several filling funnels by means of which a definite amount of explosive is filled with the help of a metering slide plate. A distribution arrangement for the supply of explosive to the loading arrangement receives containers which contain the explosive and which are clamped tightly with a spring clamp. The containers can be tipped out manually with the aid of the distribution arrangement by an operator from a safe place behind a protective wall, in order to distribute the explosive via a displaceable filing shoe evenly over the filling plate. The measuring slide plate is displaced backwards and forwards with the aid of a cable which passes over a cable roller with crank handle between two end positions, a loading position and a filling position. Moreover, the operator must turn the hand crank cautiously and delicately behind the protective wall in order to bring the metering slide plate to the end position. A tension spring in the middle of the cable effects a limiting of the cable force. With a slightly increased resistance, for example by foreign bodies in the explosive, which lead to checking of the metering slide plate, there exists the danger of explosion so that the filling process must be stopped and the loading arrangement must be cleaned. Whether there is an explosion in which the operator is endangered and in which generally the explosive filling arrangement is destroyed depends only on the attentiveness and sensitivity of the operator.

The invention is based on the object of providing a filling arrangement in which the danger resulting from explosions or other reactions is reduced and which can be operated automatically.

For the solution of this object, according to the invention, a displacement arrangement is provided which consists of a force transfer arrangement with a push rod connected with a metering slide plate and guided through the protective wall and that the force transfer arrangement is drivable by at least one weight in both directions.

The turning moments of the force transfer arrangement produced with the help of the weights form without friction and electricity, and are not time dependent and, since they are dependent only on the force of gravity, cannot exceed the highest value set for them. Such a displacement arrangement always reproducibly interrupts the filling of the material when there is too high a resistance at the metering slide plate. Possible changes through alteration of the transfer elements can only increase the operating resistance of the force transfer arrangement so that a discontinuance of operation occurs very early in all cases. Reactions as a result of erroneous assessment of the resistance at the metering slide plate by the operator or by inattentiveness of the operator are excluded with correct setting of the maximum force acting on the metering slide plate.

Preferably, at least two weights are provided of which each drives the force transfer arrangement in one other director of rotation, and at least part of the first weighting is uncoupleable from the force transfer arrangement. The uncoupling of the first weight leads directly and in the simplest possible way to the reversal of the operating direction of the turning moment.

With a preferred embodiment, the force transfer arrangement is a link drive with a fixed link in which a three-armed lever is placed which possesses a first lever arm producing a restoring turning moment loaded with the first weight, a second lever arm loaded with the second weight producing a turning moment for delivery, as well as a third lever arm connected with the push rod.

The three-armed lever connect all points of application of force with one another, with the first and the second lever arm being essentially separated by the chain in opposite directions. In this way, the necessary drive elements are reduced to a minimum.

Preferably, the weight ratio of the weights with one another is such that the restoring moment with coupled first weight is essentially equal to the delivery moment with first weight uncoupled.

In this way, the result is obtained that the force acting on the metering slide plate both with the delivery motion and also with the restoring motion is equally large so that in both directions of motion the criterion for interruption of the filling is the same.

A further embodiment of the invention provides that the delivery moment is adjustable by displacement of the position of the second weight which engages the second lever arm.

The displacement of the position of the second weight on the second lever arm and the application of additional weights to the first weight makes possible a fine tuning of the adjusted turning moment.

A preferred further embodiment possesses an arrangement for the raising and lowering of the first weight which, on raising of the first weight, initiates the delivery motion and on lowering initiates the restoring motion. This arrangement makes possible an automatic operation of the metering slide plate with control in advantageous manner.

A preferred further embodiment of the invention provides that the force transfer arrangement possesses a damping arrangement for damping of the movement of the push rod in both directions.

The constant turning moment at the lever and the constant force on the metering slide plate, respectively, leads to a constant acceleration of the slide plate so that its speed increases steadily until the end position is reached. Such a constant acceleration of the metering slide plate has the consequence that at the beginning of the movement of the metering slide plate, a lower kinetic energy is present than at the end of the movement. The damping arrangement has the effect that an equilibrium is established between the accelerating forces and the damping forces so that the metering slide plate is moved after a short acceleration with a uniform rate of movement. In this way the result is achieved that, not only the force acting on the metering slide plate, but also the movement energy assume a constant value so that even resistances which occur only at the end of the motion are not surmounted on account of the higher kinetic energy of the metering slide plate.

The push rod is sealed off at the outlet position from the protective wall with a bellows structure. Such a bellows structure reliably seals against penetrations of explosive dust in the displacement of the push rods and possesses, at the same time, a negligible frictional resistance. As a consequence, there is no possibility of the occurrence of a frictional resistance dependent on or subject to alteration or changeable with respect to time which could have an effect on the push rod and which could change the forces acting on the metering slide plate.

With a preferred embodiment, it is provided that the link drive possesses a disconnection arrangement which establishes by means of initiators arranged on the stops whether the end positions are reached and, with non-reaching of the end positions within a predetermined period of time releases a switching off.

In this way, it is made certain that, on occurrence of a jamming of the metering slide plate, no further movements are carried out in the filling arrangement.

The distributing arrangement possesses a pivotably displaced disengaging arm against which the upper container edge abuts during the pivotal motion and which is biased opposite to the tilting direction. The disengaging handle prevents, in simple manner, the container from being able to fall out of the container holder on tipping.

The disengaging handle is fixed coaxially to the shaft. This has the advantage that no friction producing relative motion can exist between the disengaging handle and the container during the pivotal motion.

Provision is made for the disengaging handle to possess one end extending outwardly over the mounting, which end carries the counterweight. In this way, the drive shaft only needs to be driven in one direction while the counterweight causes the reverse tilting of the container mounting.

A preferred embodiment has a stop for the disengaging handle which holds the disengaging handle in a position of rest on reverse reciprocation, in which position the disengaging handle lies outside the vertical space rotated over the container. In this way, whereby the disengaging handle does not overlap the vertical space located over the container, an exchanging of containers can be carried out simply and without danger.

A further aspect of the invention provides that the loading plate is pivotable over a delivery arrangement with a horizontal parallel guided loading plate support from an entry position at the entry opening to a first end position below the loading arrangement. The delivery arrangement makes possible a remotely controlled delivery of the loading plate without an operator having to remain in the filling chamber.

The delivery arrangement possesses a vertical closure plate guided past the protective all which closes the entry opening in the first end position. In this way, the safety of the filling arrangement is increased in that the entry opening in the protective wall is closed so that the pressure wave with explosions cannot widen out in neighboring places and produce damage. The entry of opening is automatically closed into the end position by the supply arrangement so that no special and separately-to-be-operated closure cap is necessary for the entry opening.

It is further provided that the delivery arrangement when in the entry position impacts against a releasable pin and after the release of the pin is pivotable into a second end position in an alignment set opposite to the loading arrangement, in which alignment the closure plate likewise closes the entry opening.

The loading arrangement of the explosive filling arrangement can, for example, with disturbances, be tipped for emptying it, with the delivery arrangement being pivoted into a retracted end position in which likewise the entry opening in the protective wall is closed, so that a high measure of security is also guaranteed in the carrying out of emptying of the loading arrangement.

In the following description, an embodiment of the invention is further described with reference to the accompanying drawings and to a filling plant for explosive, wherein:

FIGS. 3 and 4 show schematically the delivery of a loading plate; and

FIG. 5 shows the emptying of the loading arrangement.

Figure 1:
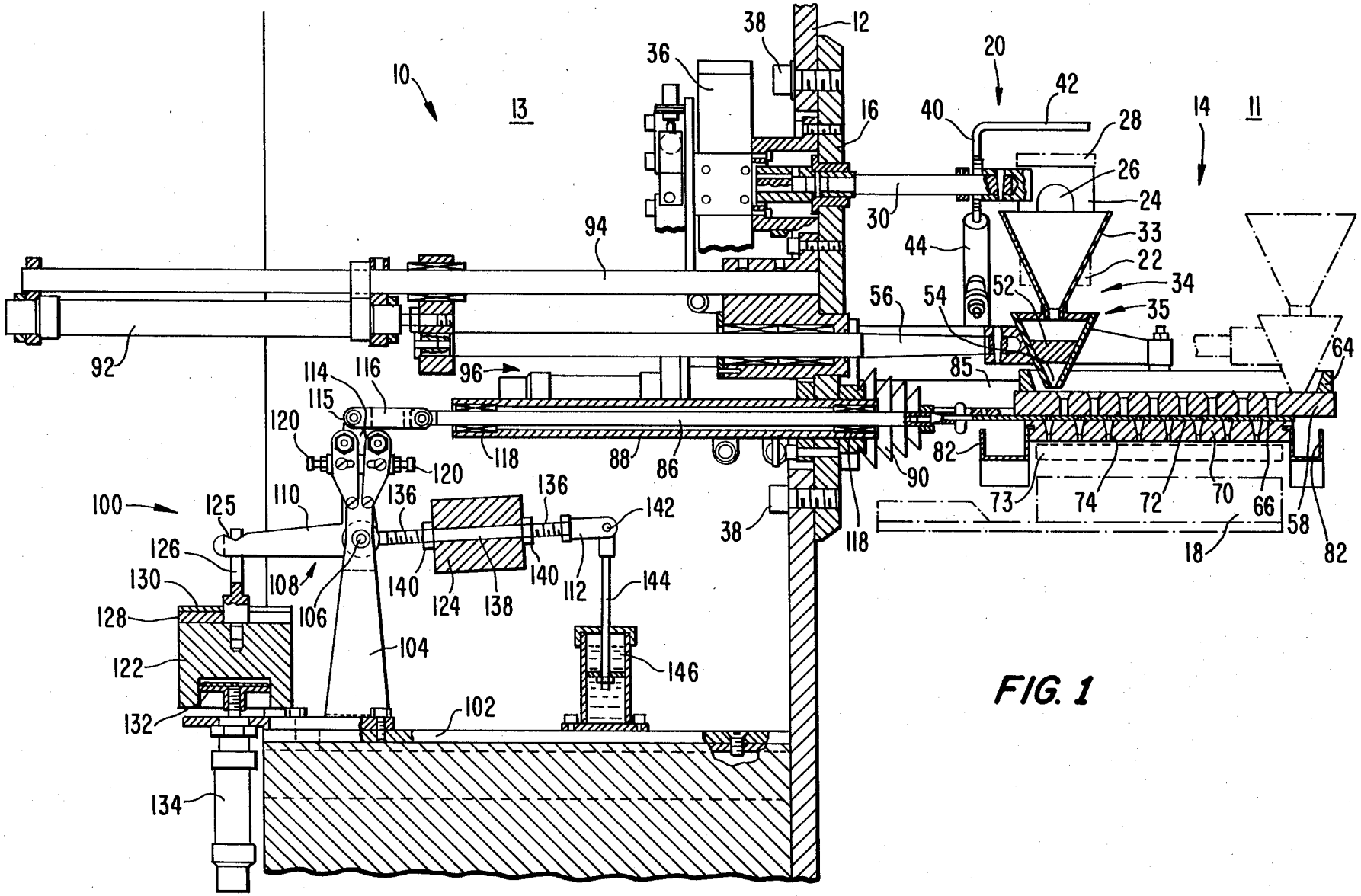
FIG. 1 is a longitudinal section through an explosive filling arrangement according to the invention.

FIG. 1 shows an explosive filling arrangement 10 with a protective wall 12 which is arranged between a loading arrangement 14 and its remotely controllable pneumatic and hydraulic operating parts. The vertical protective wall 12 includes a mounting plate 16 in which mechanical force transfer elements of the operating parts for the loading arrangement 14 and a distributing arrangement 20 are housed. The mounting plate 16 has a square configuration and is fixed to the protective wall 12 by a total of eight mounting screws 38.

The protective wall 12 subdivides the operating volume of the explosive filling arrangement 10 into a filling region 11 and a drive region 13. In the filling region 11 is located the loading arrangement 14 with as few moving parts as possible being arranged in this region, in order to prevent, as far as possible, a danger of explosion on account of static electricity. In this drive region 13 are provided the drive arrangements for the loading arrangement 14, with the driving region 13 being protected against penetration of explosive dust. The explosive filling arrangement 10 serves, in addition, for filling delay bodies arranged on a loading plate 8, for example 88 pieces, with initiator explosive, for example lead azide. In addition, as shown in FIGS. 3 and 4, the loading plate 18 is pivoted below the loading arrangement 14 and transported on after the filling to the next working station.

Above the loading arrangement 14 is a distributor arrangement 20 for delivery of explosive from containers for the explosive, which are moved by an operator from a chamber for storage of explosive. An explosive container 22 contains about 200 g of lead azide. Two containers are introduced vertically from above into two hollow cylindrical container holders 24 with a viewing window 26. The containers 22 possess an outwardly extending upper container edge 28, which is supported on the upper edge of the container holder 24. The container holder 24 has no bottom. The two container holders 24 are arranged opposite one another tippable about shafts 30 or 32, with the horizontal axes of rotation of the shafts 30,32 which pass through the protective wall 12 running eccentrically to the container holders in the upper part of the container holder 24 so that, with a circular tipping motion, the inner container edge relative to the point of rotation is applied to the edge of a funnel shaped head 33 of a filler shoe 34 which is arranged, as part of the loading or charging arrangement 14, in the middle between the two container holders 24 and whose upper edge is lower than the shafts 30,32. The shafts 30,32 lead through the mounting plate 16 to a remotely controllable hydraulic or pneumatic rotary drive 36 lying behind the protective wall 12.

The tippable container holders 24 with the shafts 30,32 are arranged symmetrically on both sides of the filling shoe 34. A disengaging arm 40 rotatably arranged on the shafts 30,32 has an arm component 42 arranged parallel to the axes of rotation of the shafts 30,32 and horizontal, which arm component lies against the respective container edge 28 on tipping of the container holder 24. At the end of the disengaging arm 40 located opposite to the arm component 42, there is located on that side of the arrangement a counterweight 44 which adjoins against an abutment 46 in the rest position of the disengaging arm 40. The stop 46 can be adjusted by threading into a flange 48 fixed on the loading arrangement 14 as a result of which the disengaging arm 40 does not extend into the vertical space located above the container holder 24 with its horizontally level arm 42 in the rest position. In this way, the explosive containers 22 can be exchanged without hindrance. The horizontal arm 42 extends over the end of the shafts 30,32 and, as apparent from FIG. 1 goes beyond the middle of the explosive container 22. The counterweight 44 consists of an elongated cylinder whose axis is offset to the outside from the part of the disengaging arm 40 leading to the horizontal arm part 42. In the rest position on the stop 46, the axis of the counterweight 44 takes up a position of about 45° to the vertical passing through the axes of the shafts 30,32 while the part of the arm leading to the horizontal arm part 42 is at an angle of about 30° to this vertical.

The container holders 24 of the distributor arrangement 20 are operated one after the other so that the shafts 30,32 are driven one after the other in a direction of rotation guiding the explosive container 22 to the filling shoe 34. After a pivoting angel of 60°, the upper container edge 24 hits against the horizontal arm part 42 and takes this part with it until the container edge 28 reaches the upper edge of the filling shoe 34 and the rotational motion of the respective shafts 30,32 is ended. In this way, the disengaging arm 40 pressing against the container edge 28 holds the explosive container 22 fast in the container holder 24 on account of the counterweight 44, with the explosive falling from the container 22 into the filling shoe 34.

The funnel shaped, round cone shaped filling shoe 34 is a part of the loading arrangement 14 and consists of the funnel shaped head 33 and a likewise funnel-shaped in cross-section (FIG. 1) and in longitudinal section (FIG. 2) rectangular distributor 35. The funnel-shaped head 33 has a lower opening 50 which opens into the distributor 35. Below the opening 50, in the central region of the distributor 35, is arranged a rod 52 triangular in cross-section which extends horizontally between the walls of the distributor 35 extending in section in a V to one another, at right angles to the protective wall 12. This triangularly shaped distributor rod serves to divert sideways within the distributor 35 explosive falling from the funnel shaped head 33, while a long edge of the triangularly shaped rod 32 runs just below the round opening 50. The distributor 35 has, at its lower end, a slit-shaped outlet opening 54 for the explosive, which opening runs parallel to the protective wall 12. Screwed onto the wall of the distributor 35 slantingly inclined to the protective wall 12 is a push rod 56 which can displace the filling shoe 34 horizontally in a direction at right angles to the protective wall between two end positions.

Moreover, the slit shaped outlet opening 54 of the filling shoe 34 slides over, with small separation, a filling plate 58 of the loading arrangement 14 which has, for each delay body located on the loading plate 18, a bore 60 with frustoconically shaped opening widening towards the upper side of the filling plate 58. The filling plate 58 is horizontally arranged and has a frame 64 attached thereto which limits the field travelled over by the distributor 35 of the filling shoe 34 so that the explosive distributed by the filling shoe 34 cannot fall sideways off the filling plate 58. The motion of the filling shoe 34 can over the filling plate 58 acts so that a 5 mm high layer of explosive is deposited on the filling plate 58.

The filling plate cooperates together with a plate-shaped essentially rectangular measuring slide plate 66 arranged below the filling plate 58, two lateral guide plates 68 arranged horizontally next to the measuring slide in the thickness of the measuring slide plate 66, and a constructional unit comprising an essentially square funnel plate 70 arranged below the measuring slide plate 66 which constructional unit his held together by holders 71 connected at the side with the filler plate 58 as well as by screw connections extending vertically through the funnel plate 70 to the filler plate 58.

The measuring slide plate 66 also has bores 72 whose bore design corresponds to the bore design of the bores 60 of the filler plate 58. The bore volumes of each bore 72 of the measuring slide corresponds exactly to the amount of explosive which is necessary for each delay body, for example 90 mg.

The funnel plate 70 possesses, likewise, bores 72 with funnel-shaped openings that widen out, with the bores 74, in comparison with the filler plate 58, being shorter and the funnel-shaped opening or widened portions directed upwardly being narrower and longer. The bores 74 are arranged according to the same bore pattern as those of the filler plate 58 and of the measuring slide 66, but are displaced in relation to the filling plate 58 in the direction of the protective wall 12 about the path of the measuring slide stroke. The pattern of bores is such that 6 or 7 bores alternatingly are arranged parallel to the protective wall 12, in a row next to one another and with the row of six being arranged in the middle in the space between the bores of the row of seven displaced in relation to the protective wall 12 around the measuring slide stroke. The bore separation of like rows of bores at right angles to the protective wall amounts to double the displacement of the measuring slide plate.

Figure 2:
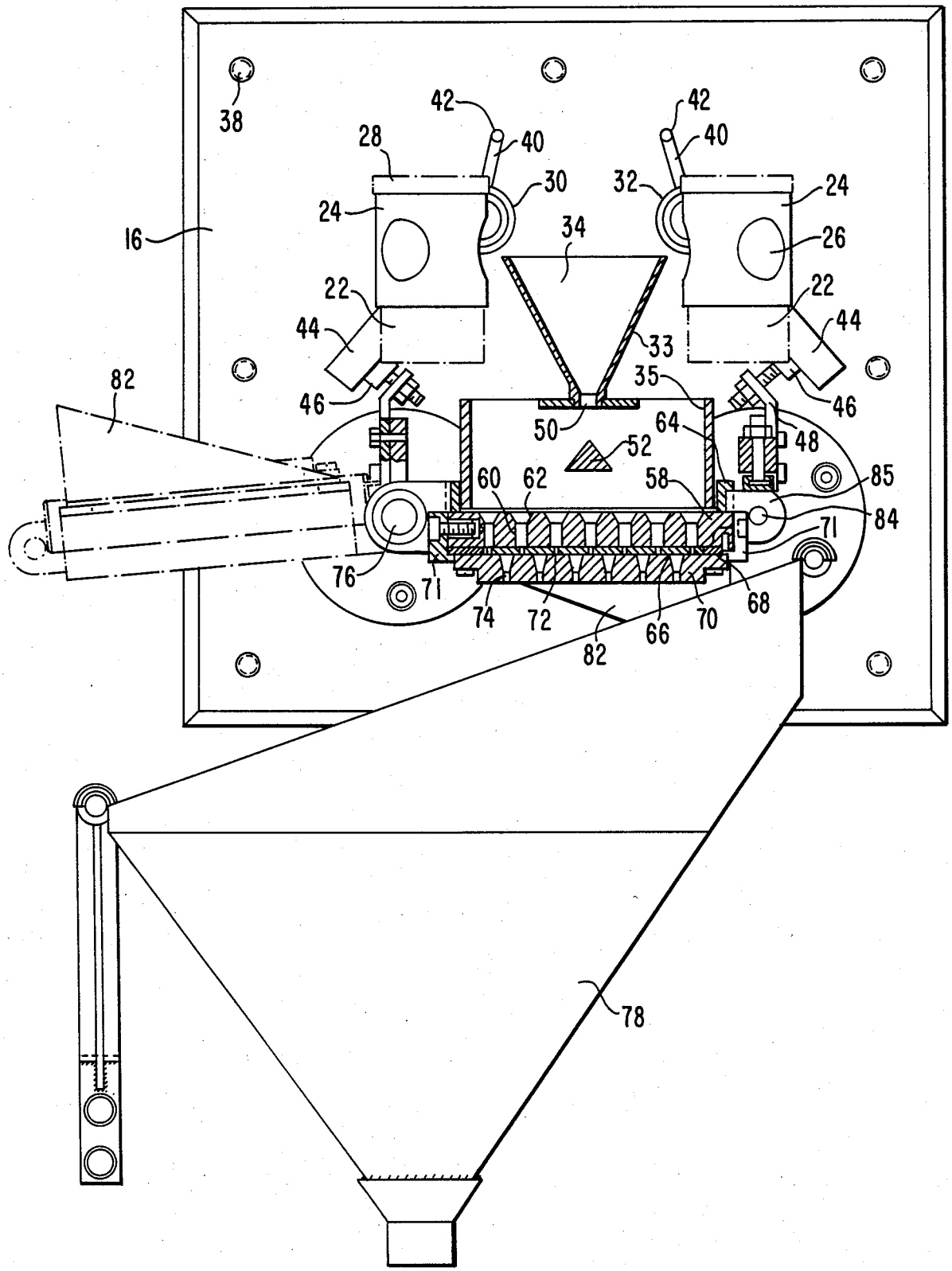
FIG. 2 is a front view with partial cross-section of the filling arrangement.

The charging arrangement 14 is, with the exception of the filling shoe 34, positioned around an axis running at right angles to the mounting plate 16 on one side of the shaft 76. The shaft 76 positioned for its part in the mounting plate 16 can pivot the loading arrangement 14, with the exception of the filling shoe, on tripping by about 180°, as indicated in FIG. 2 by broken lines so that the explosive located on the filling plate 58 and in the bores 60,72 falls into a collection funnel 78 embracing the entire pivoting region of the charging arrangement 14, which funnel delivers the tipped-out explosive, as for example apparent from FIG. 5, to an explosive collecting container 80. The upper edge of the collection funnel is inclined downwardly on to the shaft 76 in order not to restrict the pivotal motion of the loading arrangement.

The loading arrangement 14 possesses on its forward facing end a channel 82 fixed to the funnel plate 70, whose base runs downwardly inclined at an angle of 20°. The channels 82 serve for the purpose of guiding into the funnel 78 explosive possibly falling out at the front sides on account of the motion of the measuring slide 66 and, accordingly, to prevent explosive falling onto the loading plate 18.

The emptying procedure according to FIG. 5 is released by withdrawing a locking bolt 84 on the side of the loading arrangement 14 opposite to the shaft 76. The locking bolt 84 is guided in the plane of the shafts 76 in a holder 85 horizontally extending from the mounting plate 66. The operation of the locking bolt takes place by remote control by means of the mounting plate 16 with the aid of a drive 96.

The measuring slide plate 66 is operated by the mounting plate 16 by means of a push rod 86 which is positioned in a tube 88 in the mounting plate 16. The ends of the tube 88 extending into the filling chamber 11 and the push rod 86 are enclosed sealingly by a common bellows device 96 which prevents explosive dust or any smaller explosive particles being able to progress into the push rod mounting 118. In this way, a sealing with low frictional resistance is possible.

The driving chamber 13 on the side of the protective wall 12 opposite to the filling region 11 contains remotely controlled pneumatic, hydraulic and mechanical drive arrangements for the distribution arrangement 20, the filling shoe 34, the locking bolts 84 and the measuring slide plate 66. Shaft 30 located in the mounting plate 12 is driven in the upper region of the protective wall 12 by means of a rotary drive 36. Under this there is located a hydraulically or pneumatically operated piston cylinder unit 92 for the filling shoe 34, the push rod 56 of which is located into the mounting plate 16. The piston cylinder unit 92 is fixed on a horizontal rod 94 fixed to the mounting plate 16, which rod serves at the same time as guide element for the linear motion of the push rod 56. Below the piston cylinder unit 92 there is positioned in the protective wall 16 a pneumatically or hydraulically operated linear drive 96 for the locking pins 84 positioned in a tube 98.

Below the linear drive 96 is arranged the force transfer arrangement 100 for the push rod 86, consisting of a flexible coupling drive. The force transfer arrangement is mounted on a base plate 102 which is fixed to the protective wall 12. On the base plate 102 is arranged a bearing block 104 which possesses a link 106 for a three-armed lever 108. Two lever arms 110,112 of the three-armed lever 108 are directed opposite to one another from the link 106 and possess an essentially horizontal position while the third lever arm 114 stands at an angle of 90 ° to the lever arms 110 and 112 essentially vertically above the link 106. The third lever arm 114 is connected at its free end in a link with one end of the link arm 116 whose other end is connected as a link with push rod 86. The link lever 116 serves so that the circular motion of the link 115 at the end of the third lever arm 114 is converted into an absolutely linear motion of the push rod 86. The height differences determined on account of the circular motion of the link 115 are so compensated that the supports 118 in the tube 88 must take up as little force as possible. The pivotal motion of the third lever arm 114 is limited by two stops 120 arranged on both sides of the lever arm 114. The stops are adjustable and determine the stroke of the measuring slide 66. The stops 120 can comprise initiators which establish whether the end positions of the third lever arm 114 or of the measuring slide 66 are reached. Should the end position not be reached within a predetermined adjustable time span, a switching off of the entire explosive filling arrangement 10 is released.

The three-armed lever arm 108 carries on its first lever arm 110 a first weight 122 and on the second lever arm 112 a second weight 124. The first lever arm 110 possesses on its free end a notch 125 which receives a suspension loop 126 for the first weight 122. By application of additional weights 128,130, a fine adjustment of the recovery turning moment acting on the three-armed lever 108 can take place. At the underside, the first weight 122 possesses a recess for a pneumatically or hydraulically operated plunger 132 of a piston cylinder unit 134 which is fixed below the first weight 122 on the support 102. The plunger 132 of the piston cylinder unit 134 executes a vertical motion in which, in the upper end position of the plunger 132, the first weight 122 is uncoupled from the first lever arm 110. In the lower end position of the plunger 132, the first weight 122 is applied to the first lever arm 110 in the notch 125.

The second lever arm 112 possesses on the preponderant part of its length an external threading 136 while the second weight 124 possesses a bore 138 with internal threading over its longitudinal axis. The second weight 124 is in screw threaded engagement on the second lever arm 112 and secured by locking nuts 140. By displacement of the position of the second weight 124 on the lever arm 112, a fine adjustment of the rotational moment for delivery can take place. The force application points of the first weight 122 and the second weight 124, as well as of the link 115 at the free end of the third lever arm 114, lie essentially on a common circular line the second weight 124 is approximately half as heavy as the first weight 122.

The second lever arm 112 possesses at its free end a link 142 to which a vertical push rod 144 of a damping arrangement 146 filled with oil is connected. The damping arrangement 146 is likewise fixed to the base plate 102.

The loading plate 18 with delay bodies is, as apparent from FIGS. 3 and 4, pivoted below the loading arrangement 14 by means of a delivery arrangement 148. The protective wall 12 possesses an entry opening 154 arranged approximately at the level of the loading arrangement 14 and to the side thereof by which the loading plate 18 is supplied through the protective wall 12 by means of the delivery arrangement 148.

The delivery arrangement 148 consists essentially of parallel levers 150,152 located in the protective wall 12, a vertical closure plate 156 guided past the protective wall 12, in whose central region ends of the parallel levers 150,152 bent at an angle are pivoted with sideways horizontal separation, and a horizontal support 158 for the loading plate 18. The support 158 is fixed to the closure plate 156 at the end of the delivery arrangement turned towards the loading arrangement. The parallel levers 150,152 effect a parallel guiding of the closure plate 156 with the support 158 so that the support 158 is always located in horizontal position.

In FIG. 3 is shown the entry position of the delivery arrangement 148, in which the closure plate 156 adjoins, with stepping of the under edge thereof against a releasable bolt 160. At least one of the parallel levers 150,152 is fixed fast against rotation on a shaft which is fully drivable through the protective wall 12.

After the loading plate 18 is ejected onto the support 158 through the entry opening 154, the delivery arrangement 148 is brought into a first end position below the loading arrangement 14 through the operation of the parallel levers 150,152, with the forward vertical edge of the closure plate 156 abutting against a stop 162 and the rear horizontal edge of the closure plate 156 abutting against a stop 164.

For the emptying process of the loading arrangement 14 in which the lower part of the loading arrangement is pivoted, in order to empty the explosive into the collector funnel 78, the supply arrangement 148 can be pivoted into a second end position, as shown in FIG. 5, with the locking bolts 160 being withdrawn in order to divert the supply arrangement 148 away from the loading arrangement 14 over the entry position. In the second end position, the forward horizontal edge of the closure plate 156 abuts the stop 164, while the rear horizontal edge of the closure plate 156 hits against a stop 166. The ends of the closure plate 156 possess an essentially rectangular outer contour with which both in the first and also in the second position the supply opening 154 is closed with overlap.

Should the loading plate 18 be in the filling position, which corresponds to a first end position of the delivery arrangement 148, the distribution arrangement 20, into whose container holders 24 an operator has introduced two explosive containers 22 filled with lead azide, is set in operation. Moreover, the two explosive containers 22 are tipped into the funnel-shaped head 33 of the filling shoe 34 by means of the remotely controlled rotary drive 36 and the two shafts 30 one after the other. The filling shoe 34 is then slowly pushed over the filling plate 58 of the loading arrangement 14 and leaves behind the up to approximately 5 mm thick explosive layer.

The filling of the explosive into the delay bodies on the charging plate 18 happens in the following way: the measuring slide plate 66 is held by the force transfer arrangement 110 like a beam balance initially by the heavy first weight 122 in the loading position, as shown in FIG. 1. On operating the plunger 132, the first weight 122 is uncoupled from the first lever arm 110 whereby the second weight transfers a constance force in the delivery connection to the push rod 86 and the measuring slide plates 66. The third lever arm 114 abuts, in the filling position of the measuring slide plate 66, the stop 120 turned towards the protective wall 12. Since the ratio of the weights amounts to 1:2, the turning moment produced in delivery or restoration direction is equally high. Should the resistance force of the measuring slide plate 66 be higher than the force transferred to the measuring slide 66, in both directions, on account of foreign bodies or on account of frictional resistances, a locking of motion occurs immediately so that the initiators on the stops 120, on elapse of a previously set waiting time, switch off the explosive filling arrangement on account of the disturbance. The weights 122, 124 operate so that any constant force of the order of size of the lighter second weight 124 acts on the push rod 86 and, accordingly, subsequently on the measuring slide plate 66. In order additionally to limit the kinetic energy resulting from the motion of the force transfer element and the measuring slide plate 66, the damping arrangement 146 is provided on the second lever arm, and limits the acceleration of the force transfer arrangement.

The lighter second weight 124, therefore, brings the measuring slide plate into the filling position and, after a selectable delay time, the heavier first weight 122, after lowering of the plunger 132, effects a restoration into the loading position in which the explosive falls into the delay bodies through the funnel plate 70 and a loading surface 73 arranged between funnel plate 70 and loading plate 18.

The force transfer arrangement 100 makes possible with the damping arrangement 146 at least the same sensitivity in manipulation of the measuring slide plate 66 as by hand.

After the loading process, the supply arrangement 148 pivots back with the loading plate 18 into the introduction position, with the loading plate 18 being brought by means of a push rod into the next working position.

All working procedures described so far for the explosive filling arrangement are switched and monitored by an electrical control. For this purpose, a sequence control is used in which each motion is only then introduced if the previous one has ended. With a disturbance, the apparatus is switched off after the elapse of a waiting time of about 3 seconds.

What is claimed is:

1. A filling arrangement for dangerous substances, especially exposives, which comprises a loading arrangement containing a measuring slide plate and a displacement arrangement guided through a protective wall which displaces the guiding plate backwards and forwards between two end positions; the displacement arrangement comprising a force transfer arrangement with a push rod guided through the protective wall connected with the measuring slide plate, the force transfer arrangement being drivable in both directions by at least a first weight and a second weight, each of which drives the force transfer arrangement in a different rotational direction and at least a part of the first weight being uncoupleable from the force transfer arrangement; said second weight acting to move said push rod forward through said protective wall when at least a part of said first weight is uncoupled from the force transfer arrangement and said first weight acting to move said push rod backwards through said protective wall when said at least a part of said first weight is coupled to said force transfer arrangement.

2. A filling arrangement according to claim 1, wherein an arrangement for lifting and lowering the first weight is provided which initiates a supply motion on lifting of the first weight and a return motion on its lowering.

3. A filling arrangement according to claim 1, which further comprises a distribution arrangement for delivery of an explosive material for filling from containers to a loading arrangement including said measuring slider plate; the distribution arrangement having at least one container holder which is tippable by a shaft guided through the protective wall.

4. A filling arrangement according to claim 3, wherein the upper edge of the container holder is formed as a support for a laterally projecting container upper edge.

5. A filling arrangement according to one of claims 3 and 4, wherein the distribution arrangement has a pivotally mounted disengaging arm against which the container upper edge abuts during the pivotal motion and which is biased against the pivotal motion.

6. A filling arrangement according to claim 5, wherein the disengaging arm is mounted coaxially with respect to the shaft.

7. A filling arrangement according to claim 6, wherein the disengaging arm has an end which carries a counterweight extended over a mounting element.

8. A filling arrangement according to claim 5, wherein a stop for the disengaging arm is provided which holds the disengaging arm in a rest position with return oscillations, in which position the disengaging arm lies outside the space located vertically over the container.

9. A filling arrangement according to claim 1, which further comprises a loading arrangement including said measuring slide plate; and a loading plate with containers to be filled delivered through the protective wall via an entry opening; the loading plate being pivotable over a delivery arrangement with a horizontal, parallel guiding loading plate support from an entry position at the entry opening into a first end position below the loading arrangement.

10. A filling arrangement for dangerous substances, especially explosives, which comprises a loading arrangement containing a measuring slide plate and a displacement arrangement guided through a protective wall which displaces the guiding plate backwards and forwards between two end positions; the displacement arrangement comprising a force transfer arrangement with a push rod guided through the protective wall connected with the measuring slide plate, the force transfer arrangement being drivable in both directions by at least two weights including a first weight and a second weight, each of which drives the force transfer arrangement in a different rotational direction and at least a part of the first weight being uncoupleable from the force transfer arrangement; said force transfer arrangement being a link drive with a fixed link, and in the fixed link is located a three armed lever which possesses a first lever arm producing a restoring rotary movement acted upon by the first weight, a second lever arm producing a delivery rotary movement acted upon by the second weight as well as a third lever arm connected with the push rod.

11. A filling arrangement according to claim 10, wherein the weight ratio of the weights to each other is such that the restoring rotary moment with the coupled first weight is essentially equal to the delivery rotary moment with the uncoupled first weight.

12. A filling arrangement according to claim 10, wherein the delivery rotary moment is adjustable by displacement of the position of the second weight engaging the second lever arm.

13. A filling arrangement according to claim 10, wherein the force transfer arrangement has a damping arrangement for the damping of the push rod motion in both directions.

14. A filling arrangement according to claim 13, wherein the damping arrangement engages one of the lever arms.

15. A filling arrangement according to claim 10, wherein the push rod is sealed at the outlet position from the protective wall with a bellows structure.

16. A filling arrangement according to claim 10, wherein the path of the third lever arm is limited between two stops.

17. A filling arrangement according to claim 16, wherein the link drive has a disconnection arrangement which, establishes by means of initiators arranged above the stops whether the end positions are reached and, on not reaching the end positions within a predetermined time span, releases a switching off.

18. A filling arrangement according to claim 9, wherein the delivery arrangement is connected to the protective wall by parallel levers.

19. A filling arrangement according to claim 9 or 18, wherein the delivery arrangement has a vertical closure plate directed past the protective wall, which plate closes the entry opening in a first end position.

20. A filling arrangement according to claim 19, wherein the delivery arrangement abuts in the entry position against a releasable bolt and after the releasing of the bolt is pivotable into a second end position in a direction located opposite to the loading arrangement, in which end position the closure plate likewise closes the entry opening.

21. A filling arrangement according to claim 20, wherein the parallel levers are linked in the central region of the closure plate and the ends of the closure plate matched essentially to an outer contour of the inlet opening close the entry opening in the respective end positions.

22. A filling arrangement according to claim 21, wherein at least one parallel lever is driveable by a shaft guided through the protective wall.

* * * * *